US005544863A

United States Patent [19]

Ueno et al.

[11] Patent Number: 5,544,863

[45] Date of Patent: Aug. 13, 1996

[54] MANUAL CHAIN BLOCK

[75] Inventors: Yoshio Ueno; Yasuo Wada, both of Osaka Sayama, Japan

[73] Assignee: Elephant Chain Block Company Limited, Osaka, Japan

[21] Appl. No.: 265,777

[22] Filed: Jun. 27, 1994

[30] Foreign Application Priority Data

Jul. 2, 1993 [JP] Japan ..... 5-164896
Jul. 2, 1993 [JP] Japan ..... 5-164897

[51] Int. Cl.[6] ..... B66D 1/20

[52] U.S. Cl. ..... 254/358; 254/372

[58] Field of Search ..... 254/358, 372, 254/346–357

[56] References Cited

U.S. PATENT DOCUMENTS 3,894,720 7/1975 Koji ..... 254/358
5,007,617 4/1991 Nishimura et al. ..... 254/372
5,125,629 6/1992 Nishimura ..... 254/358

FOREIGN PATENT DOCUMENTS 0131380 1/1985 European Pat. Off. .
0602946 6/1994 European Pat. Off. .
1253889 11/1967 Germany .
40-8997 3/1965 Japan .
192851 2/1923 United Kingdom .
629671 9/1949 United Kingdom .

*Primary Examiner*—John M. Jillions
*Attorney, Agent, or Firm*—Watson Cole Stevens Davis P.L.L.C.

[57] ABSTRACT

In a manual chain block having a load sheave and an actuating mechanism with a cover 15 thereover there is provided a cover holding member 50 having side surfaces 51, 52 which define lower opening edges of introducing openings 15*b*, 15*c* for a hand chain 40 and a cover receiving portion 55 which is located between the introducing openings 15*b*, 15*c* to receive the wheel cover 15. The cover holding member 50 is tightened by stay bolts 12 onto a side plate 1 of the hoist together with the wheel cover 15.

13 Claims, 8 Drawing Sheets

MANUAL CHAIN BLOCK

BACKGROUND OF THE INVENTION

1. Field of the Invention

The present invention relates to a manual chain block, and more specifically to a manual chain block having a load sheave supported rotatably between a pair of side plates so that the load sheave can be rotated by an actuating operation of an actuating mechanism having a hand wheel to wind up and unwind a load chain looped around the load sheave.

2. Description of Prior Art

In a conventional manual chain block adapted to rotate a load sheave by operating an actuating mechanism having a hand wheel, for example as disclosed in the Japanese Utility Model Publication No. Sho. 40 (1965)—8997, a wheel cover for covering the actuating mechanism is attached to an outerside of a side plate.

As shown in FIG. 15, this wheel cover has introducing openings 103, 104 for a hand chain 102 looped around a hand wheel 101, formed in a lower portion of a cover body 100 on its opposite sides relative to the hand wheel 101 and a lower cover side wall 105 so formed integrally with the cover body 100 between those introducing openings 103, 104 to define lower opening edges of the introducing openings 103, 104 with the cover body 100. The cover body 100 is fixedly secured by a plurality of stay bolts 106 to an actuating mechanism side side plate 107 of two side plates 107, 108 for supporting a load sheave (not illustrated).

Incidentally, in FIG. 15, the symbol 109 designates a gear cover and the symbol 110 , denotes a hand chain guide.

The wheel cover having the above-mentioned constitution is formed from a sheet metal, and the lower cover side wall 105 defining the lower opening edges of the introducing openings 103, 104 is formed integrally with the cover body 100 by a pending process. Because the lower cover side wall 105 is formed of the sheet metal similarly to the cover body 100 and pushed and secured to the side plate 107 by tightening nuts 111 threadably engaged with the stay bolts 106, its strength is insufficient. Therefore, the cover side wall 105 is formed comparatively wide as shown in FIG. 15.

While the opposite side edges of the cover side wall 105 define the introducing openings 103, 104, the cover side wall 105 is formed wide for attaining its sufficient strength. Accordingly, the opposite side edges of the cover side wall 105 come close the introducing passages of the hand chain 102 passing through the introducing openings 103, 104. When the hand chain 102 is operated abruptly and violently to jump up or when a large load is imposed to the hand chain 102 to incline the whole of the chain block, the hand chain 102 is brought into contact with the edges of the cover side wall 105. The resulting rubbing causes unpleasant noises to be generated and the cover side wall 105 is deformed by repetition of the contact for a long term use. There is also a problem in that the cover side wall 105 is deformed and damaged by an impact imposed from outside thereto so that the hand chain 102 is hindered from passing during a normal usage.

SUMMARY OF THE INVENTION

It is a principal object of the present invention to provide a manual chain block in which durable strength of lower opening edges of a passage openings for a hand chain in a wheel cover can be increased, the lower opening edges of the passage openings are made remote from an introducing a pathway or passage of usual movement of the hand chain to decrease chances of contact with the hand chain and to decrease chances of generations of noises. Correspondingly the durability can be improved and generations of noises can be restrained even when the hand chain is brought into contact with the wheel cover.

It is another object of the present invention to improve the workability for mounting a hand chain guide to an interior of a wheel cover, to reinforce the wheel cover sufficiently by a hand chain guide allowing to smoothly guide the hand chain to a hand wheel and to enable a user to smoothly carry out a pulling operation of the hand chain while ease of manufacture of the wheel cover can be improved along with the improvement of the workability.

Thus, for accomplishing the above-mentioned objects, the invention disclosed herein includes a manual chain block including, as shown in FIGS. 1 through 3, a load sheave 3 which is supported rotatably between a pair of side plates 1, 2 and around which a load chain is looped, an actuating mechanism 20 which is disposed outside one of the side plates and has a hand wheel 8 for actuating the load sheave 3 and a wheel cover 15 which is attached to the one side plate 1 to cover the actuating mechanism 20 and has introducing openings **15*b*, 15*c* for a hand chain 40 looped around the hand wheel 8. Between the introducing openings 15*b*, 15*c* there is provided a cover holding member 50 having side surfaces 51, 52 which face introducing passages 60 for the hand chain 40 and define lower opening edges of the introducing openings 15*b*, 15*c* and a cover receiving portion 55 for receiving the wheel cover 15 located between the introducing openings 15*b*, 15*c*, and the cover holding member 50 is tightened together with the cover 15 to the side plate 1 by stay bolts 12**.

In the invention as shown in FIG. 6, the respective side surfaces 51, 52 are disposed at locations spaced apart from the introducing passages 60 for the hand chain 40. Further, in the invention the cover holding member 50 may be formed from a vibration resistant material, for example such as cast iron, aluminum and synthetic resin.

In the invention, as shown in FIGS. 6 and 7, between the introducing openings **15*b*, 15*c* of the wheel cover 15 for the hand chain 40 there is provided a short cover engaging piece 15*i* having an arcuate cross-section, and an engaging surface 54 adapted to engage with an inner surface of the cover engaging piece 15*i* is formed in the cover receiving portion 55 of the cover holding member 50. The locations of the lower opening edges can be made remote from the introducing passages 60 of the hand chain 40 passing through the introducing openings by narrowing a width between the side surfaces 51, 52 defining the lower opening edges of the introducing openings. Accordingly, it is possible to decrease the chances of contact with the hand chain, to decrease the chances of generation of noises and to improve the durability. Further, since the cover holding member 50 is formed as a separate member from the wheel cover 15, it is possible to restrain the generation of noises even when the hand chain 40** is brought into contact therewith and also to decrease the weight in case that it is formed from a light material such as aluminum.

According to the invention the respective side surfaces 51, 52 of the cover holding member 50 are disposed at the locations remote from the usual pathway or passage 60 of the hand chain 40, even when the whole of the chain block is made to jump by an abrupt and violent operation of the hand chain 40 or inclined by the effect of a large load, it is possible to decrease the chances of contact of the hand chain 40 with the side surfaces 51, 52 to make it more silent to improve its durability.

In addition thereto, since the hand chain guide 44 has the attachment portion 44*a* interposed between the tightened portion and the stay bolt 12 and the held portion 44*b* held and engaged with the side plate 1, it is possible to define a box-like section together with the cover side wall 15*a* of the wheel cover 15 and the side plate 1, so that the wheel cover 15 can be reinforced sufficiently by the hand chain guides 44.

According to the invention since the outer surface of the attachment portion 44*a* is so formed as to coincide with the inner surface of the cover side wall 15*a*, the outer surface of the attachment portion 44*a* is brought into contact with the inner surface of the cover side wall 15*a* or comes near thereto. Therefore, when an impact is imposed thereon from outside, the cover side wall 15*a* is going to deform inward. But, that impact is received by the stay bolts of high rigidity through the attachment portions 44*a* of the hand chain guides 44 to restrain a deformation of the wheel cover 15 effectively, so that a reinforcement function for the wheel cover 15 can be further improved.

According to the invention since the guide passage 45 is formed in the guide portion 44*c*, even if the hand chain 40 jumps within the wheel cover 15, it is possible to prevent the chain 40 from getting out of the hand wheel 8 and it becomes possible to carry out a smooth operation of the hand chain 40.

According to the invention since the hand chain guide 44 is formed from a vibration resistant material, even when the hand chain 40 is brought into contact with the hand chain guides 44, it is possible to restrain the generation of noises. According to the invention as since the vibration resistant layer 48 is formed on the guide portion 44*c* of the hand chain guide 44, similarly to the hand chain guide 44 formed from the vibration resistant material, it is possible to restrain the generation of noises even when the hand chain 40 is brought into contact therewith.

According to the invention since the vibration absorbing material 49 such as a rubber packing is interposed between the attachment portion 44*a* and the tightened portion of the wheel cover 15, even when the hand chain is brought into contact with the hand chain guide 44, it is possible to prevent unpleasant noises from being generated by the resonance of the wheel cover 15. Further, according to the invention as since the attachment portions 44*a* of the hand chain guides 44 are fixed to the tightened portions of the wheel cover 15 by means of a spot welding, it is possible to improve the hand chain guides 44 between the wheel cover 15 and the side plate 1. Thereupon, since that fixation is not intended to reinforce the wheel cover 15 by the hand chain guides 44 but merely intended to connect them for preventing separation therebetween, it is possible to not only improve the mountability but also reinforce the wheel cover 15 sufficiently by the above-mentioned fixation.

Further, according to the invention since the held portion 44*b* is provided with the lug 44*g* so that the lug 44*g* can be fitted into the fitting hole 46 formed in the side plate 1 to hold the held portion 44*b* by engagement with the side plate 1, the hand chain guide 44 can be strongly secured and held by the side plate 1. Thereupon, the box- like section defined by the side wall 15*a*, the side plate 1 and the hand chain guide 44 can be made stronger so that reinforcement of the wheel cover 15 can be accomplished more securely by that box-like section.

BRIEF DESCRIPTION OF THE DRAWINGS

The above and other objects, advantages and features of the invention will become apparent when considered with the following specification and accompanying drawings wherein.

DESCRIPTION OF THE PREFERRED EMBODIMENT

Figure 1:
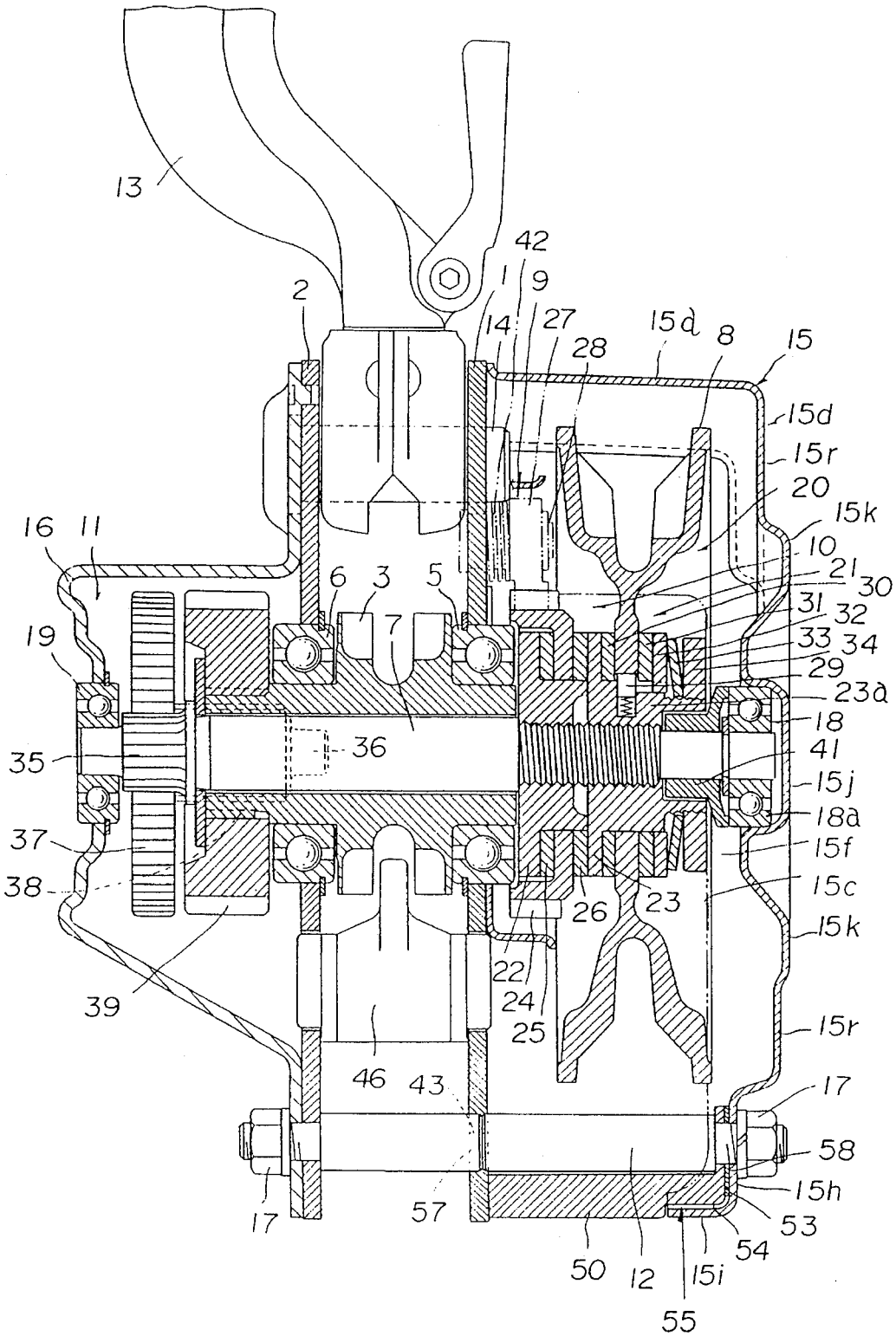
FIG. 1 is a vertical sectional view showing one embodiment of a manual chain block according to the present invention.

A manual chain block illustrated in FIG. 1 is a chain block of the manual lifting and lowering type in which a load sheave 3 around which a load chain (not illustrated ) is looped is rotatably supported between a pair of first and second side plates 1, 2 through bearings 5, 6. A driving shaft 7 is passed through a shaft bore of the load sheave 3 while being provided at its axial one end with a hand wheel 8 around which an endless hand chain 40 (refer to FIG. 2) is looped. A transmission mechanism 10 provided with a mechanical brake 9 is disposed between the hand wheel 8 and the driving shaft 7. The driving shaft 7 is provided at its axial other end with a reduction gear mechanism 11 having a plurality of reduction gears. A driving force is transmitted to the load sheave 3 through the transmission mechanism 10 and the reduction gear mechanism 11 by actuating the hand wheel 8 through the hand chain, so that a hanging member (not illustrated) comprising a hook and the like connected to the load side of a load chain looped around the load sheave 3 can be lifted and lowered.

The side plates 1, 2 are connected to each other by three stay bolts 12 which maintain a predetermined space therebetween. A mounting shaft 14 for a hook 13 is attached between upper portions of those side plates 1, 2 at the locations along the tangential direction of the load sheave 3.

While a wheel cover 15 for covering the hand wheel 8 is attached to the side plate 1 and fixed thereto by nuts 17 threadably engaged with the stay bolts 12, a gear cover 16 for covering the reduction gear mechanism 11 is attached to the side plate 2 and also fixed thereto by the nuts 17.

The wheel cover 15 and the gear cover 16 are provided with radial bearings 18, 19 for the driving shaft 7 respectively, so that the driving shaft 7 can be supported rotatably at its axial opposite end portions by the covers 15, 16 through the bearings 18, 19 separately from the load sheave 3. Thereupon, a predetermined clearance is kept between the driving shaft 7 and a shaft bore of the load sheave 3 which is supported rotatably by the side plates 1, 2 through bearing 5, 6.

Figure 2:
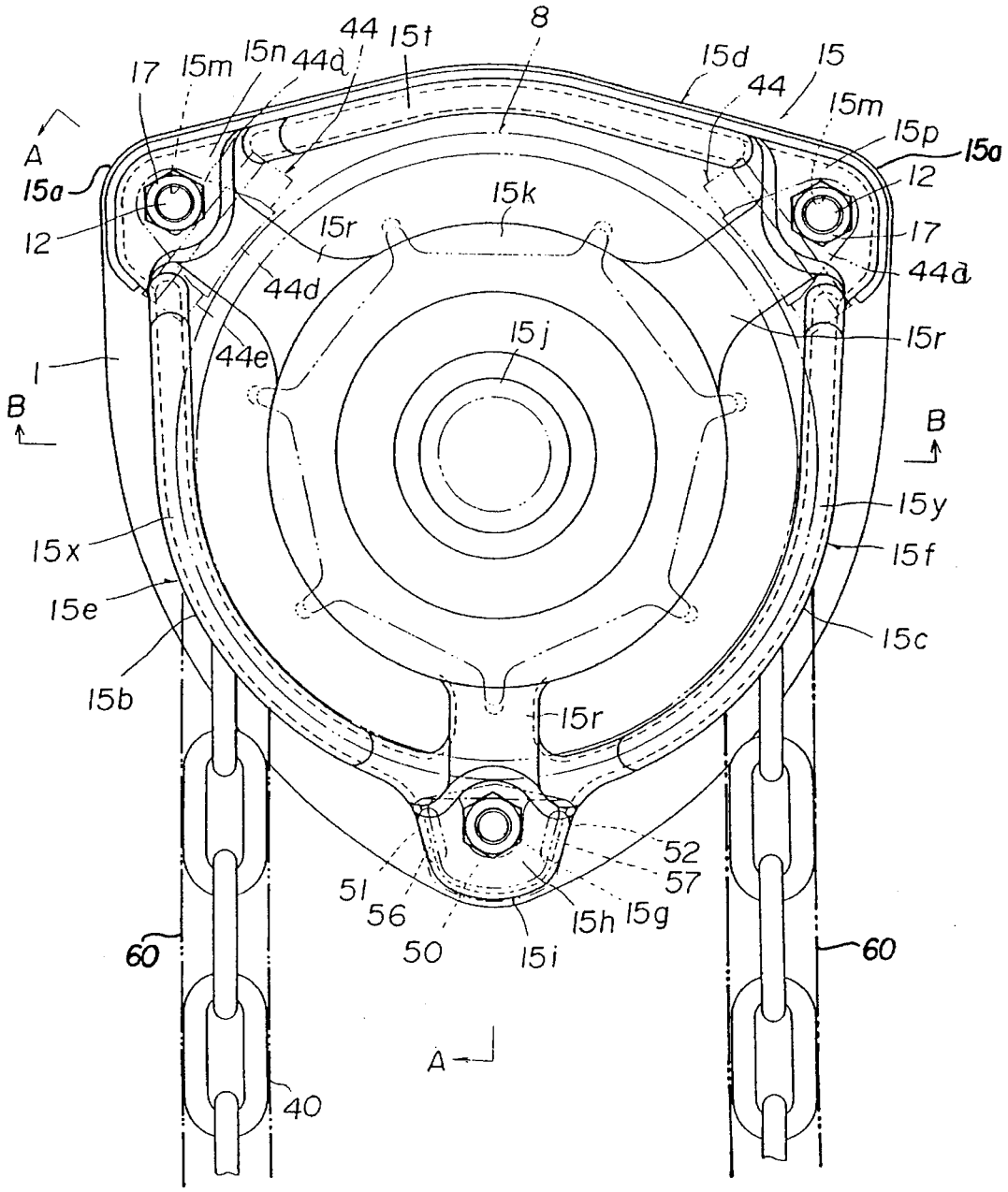
FIG. 2 is a front view showing a wheel cover portion.

The hand chain 40, the hand wheel 8 and the transmission mechanism 10 constitute an actuating mechanism 20, and the embodiment illustrated in FIGS. 1 and 2 is provided with an overload prevention mechanism 21.

The transmission mechanism 10 comprises a driven hub 22 joined to the drive shaft 7 so as not to rotate relatively thereto (threadably jointed to each other in FIGS.), a driving member 23 threadably engaged with the driving shaft 7, a reverse prevention gear 24 interposed between the respective flange portions of the driven hub 22 and the driving member 23 and supported rotatably by the driven hub 22 and lining plates 25, 26 interposed respectively between the driven hub 22 and the reverse prevention gear 24 and between the reverse prevention gear 24 and the driving member 23. A reverse prevention pawl 27 meshed with the reverse prevention gear 24 is swingably mounted to the side plate 1 through a pawl shaft 28. This reverse prevention pawl 27, the reverse prevention gear 24, the driven hub 22, the driving member 23 and the lining plates 25, 26 constitute the mechanical brake 9.

The overload prevention mechanism 21 supports the hand wheel 8 by a cylindrical boss portion 23*a* of the driving member 23 through a one-way clutch 29 allowing rotation in the normal driving direction, has a lining plate 30 disposed between the flange portion of the driving member 23 and a boss portion of the hand wheel 8, and also has a lining plate 31 and a press plate 32 rotatable together with the cylindrical boss portion 23*a* and a resilient member 33 comprising an initially coned disc spring fitted in order onto the cylindrical boss portion 23*a* of the driving member 23 outside the hand wheel 8, is an urging force setting adjuster 34 threadably engaged with an end of the boss portion 23*a* outside the resilient member 33 to optionally set a slipping load of the hand wheel 8 relative to the driving member 23 by adjusting an urging force of the resilient member 33.

Further, the reduction gear mechanism 11 comprises a first gear 35 formed integrally with a shaft end of the driving shaft 7, a pair of second gears 37, 37 supported by intermediate shafts 36, 36 respectively so as to mesh with the first gear 35, a pair of third gears 38, 38 provided in the intermediate shafts 36, 36 and a fourth gear 39 connected to an extended portion of the load sheave 3 so as to mesh with the third gears 38, 38.

Incidentally, in FIG. 1, the symbol 41 designates a wheel stopping member interposed between an axial end face of the driving member 23 and an outer ring 18*a* of the radial bearing 18 to restrain an axial outward shift of the hand wheel 8 through the driving member 23, the symbol 42 designates a pawl spring adapted to urge the reverse prevention pawl 27 toward a reverse prevention gear 24, and the symbol 46 does a chain kicker.

Thus, in the above mentioned construction, when the hand wheel 8 is actuated in the normal direction by operating the hand chain, the driving shaft 7 is driven through the transmission mechanism 10 having the overload prevention mechanism 21 and the mechanical brake 9 so that the driving force is transmitted to the load sheave 3 through the reduction gear mechanism 11 to rotate the load sheave 3. Thereupon, the load side portion of the load chain 4 looped around the load sheave 3, namely the load side portion having a hook attached to its leading end for hanging a cargo can be wound up to lift the cargo.

When a load larger than the slipping load set by the adjuster 34 of the overload prevention mechanism 21 acts on the load side portion of the load chain 4 at the time of lifting the cargo, the hand wheel 8 slips relative to the driving member 23 so that cargo lifting thereafter is stopped. Thereupon, a level of the cargo lifted thus far is held by action of the mechanical brake 9.

When the lifted cargo is lowered, the hand chain 40 is operated to actuate the hand wheel 8 in the reverse direction. Thereupon, the driving member 23 is retreated due to a screw effect by reversely actuating the hand wheel 8, so that the load sheave 3 is rotated reversely by alternately repeating an action and an inaction of the mechanical brake 9 to gradually carry out the cargo lowering.

According to the present invention, in the manual chain block having the above-mentioned construction lower opening edges of introducing openings 15*b*, 15*c* are formed in the wheel cover 15 for the hand chain 40 by using a cover holding member 50, and the lower portion of the wheel cover 15 is fixedly secured onto the side plate 1 by the stay bolt 12 through the cover holding member 50.

Figure 7:
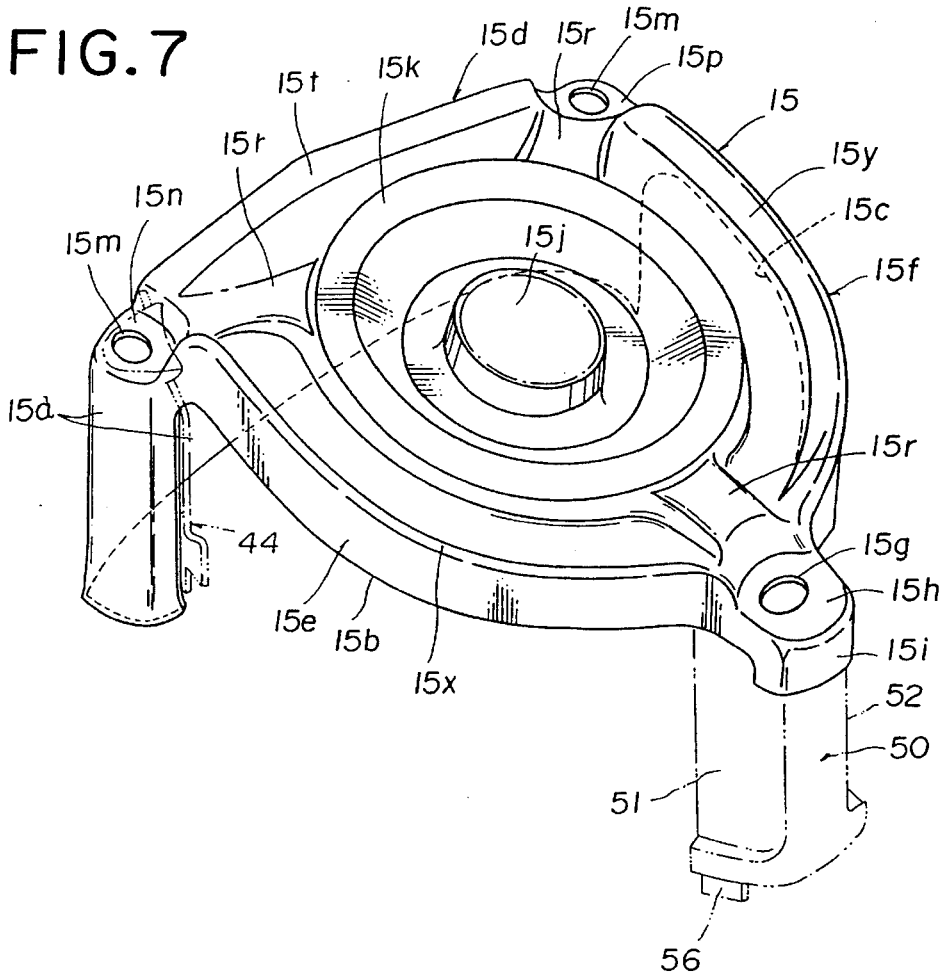
FIG. 7 is a perspective view showing the wheel cover.

As shown in FIGS. 2 and 7, the wheel cover 15 is located radially outside the outer peripheral surface of the hand wheel 8 and so configured as to have an upper side portion 15*d* with a cover side wall 15*a* having opposite side extended to its turned down portions toward its left and right sides at a predetermined height. Left and right side portions 15*e*, 15*f* having the introducing openings 15*b*, 15*c* for the hand chain 40 are configured along the outer peripheral portion of the hand wheel 8. A lower tightened portion 15*h* is joined to the lower portions of those side portions 15*e*, 15*f* while protruding radially outward relative to the outer peripheral portion of the hand wheel 8 so as to have a bolt passing opening 15*g* for the stay bolt 12 and adapted to sit on a seat 53 of the cover holding member 50 and to be tightened together therewith by the stay bolt 12.

In the lower tightened portion 15*h* of the wheel cover 15 there is provided a short cover engaging piece 15*i* joined to the side portions 15*e*, 15*f* which define the introducing openings 15*b*, 15*c* formed therein and having an arcuate cross-section. In the center portion of the wheel cover 15 there is provided a concaved portion 15*j* for holding the radial bearing 18 therein. Outside the concaved portion 15*j* there are provided an annular rib 15*k* and reinforcement ribs 15*r* extending radially outward from the annular rib 15*k*.

Figure 4:
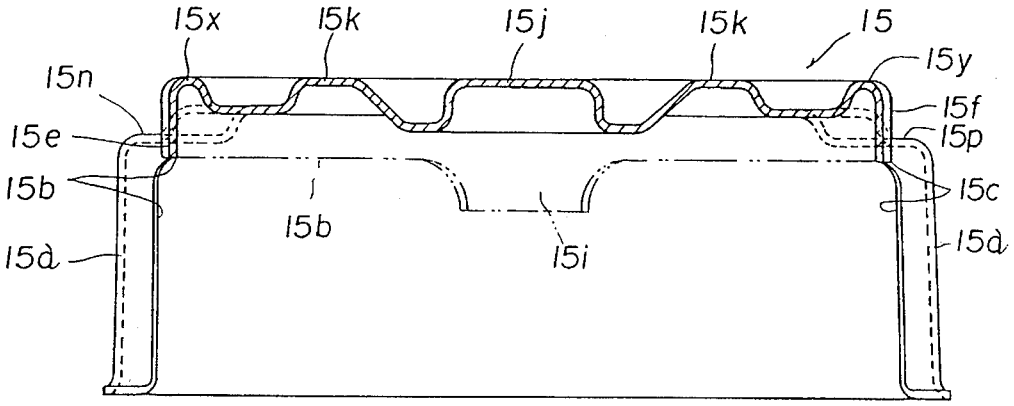
FIG. 4 is a sectional view showing only the wheel cover and taken along the B—B line in FIG. 2.
Figure 5:
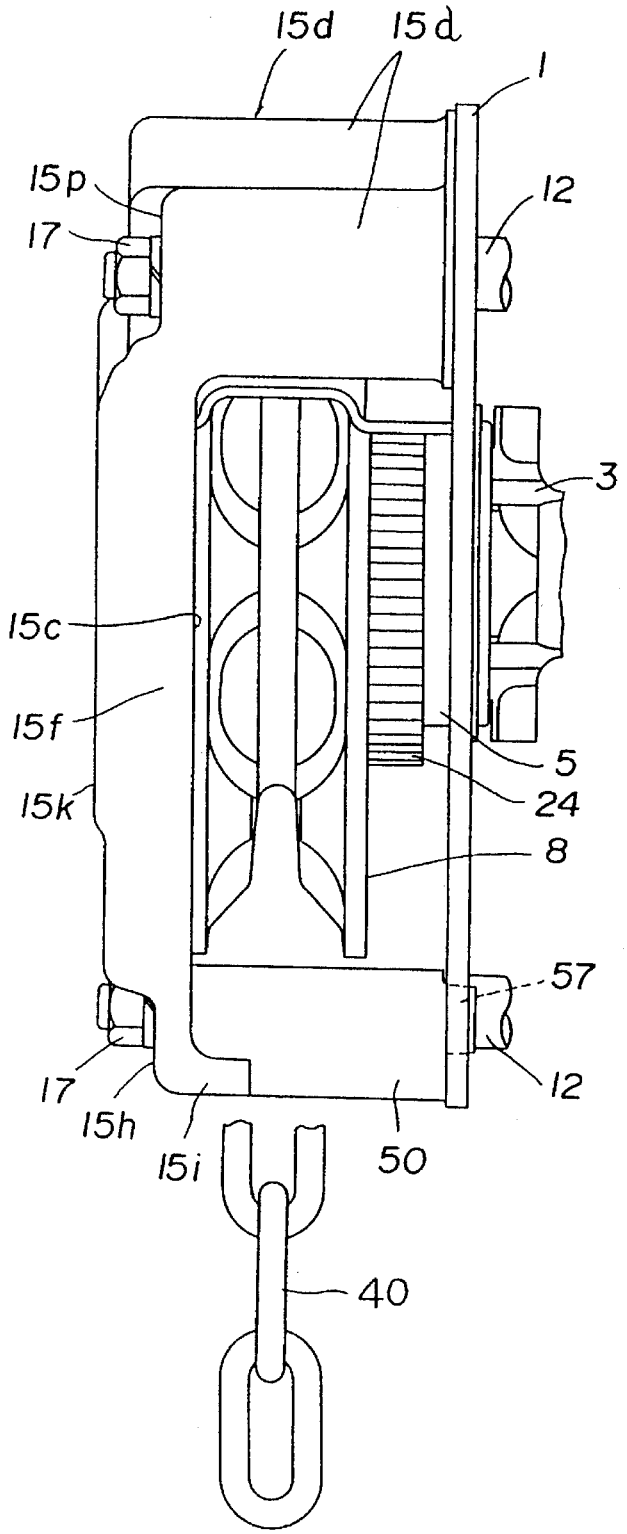
FIG. 5 is a side view showing the wheel cover portion.
Figure 14:
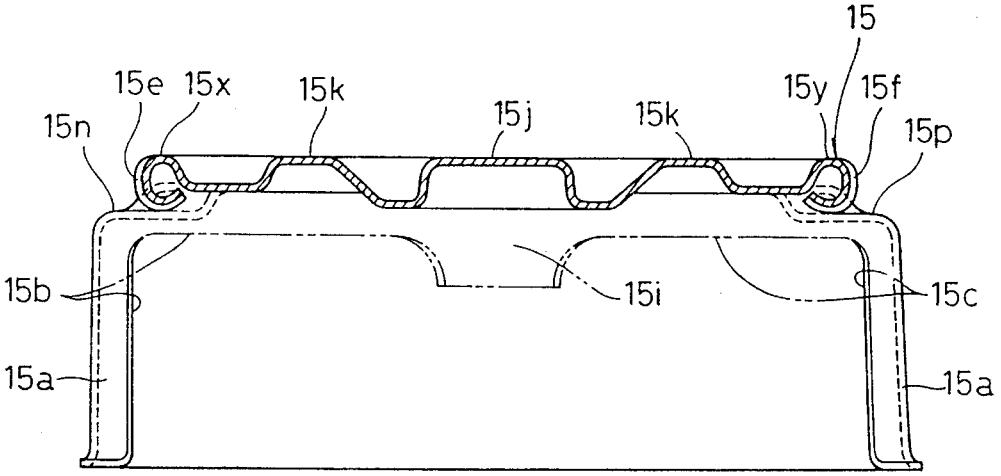
FIG. 14 is a sectional view showing another embodiment of a wheel cover correspondingly to FIG. 4.
Figure 15:
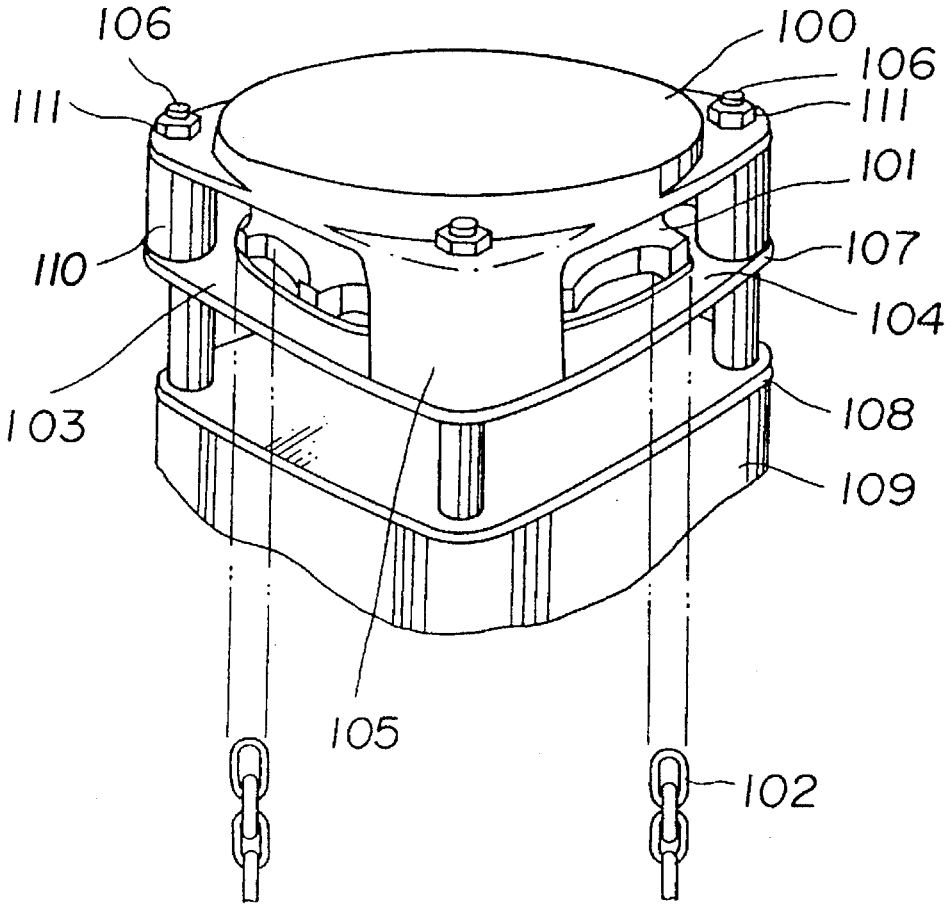
FIG.15 PRIOR ART
FIG. 15 is an explanatory view showing a conventional embodiment.

The upper side portion 15*d* of the wheel cover 15 has passing openings 15*m* for the stay bolts 15 formed at its right and left corners together with upper tightened portions 15*n*, 15*p* for nuts 17 threadably engaged with the stay bolts 12 so as to be fixed at three locations together with the lower tightened portion 15*h* provided in the lower portion of the wheel cover 15 when the nuts 17 are tightened relative to the stay bolts. Between the corners of the upper side portion 15*d* there is provided a reinforcement rib 15*t* running between the upper tightened portions 15*n*, 15*p*. Along the side edge portions of the respective side portions 15*e*, 15*f* there are provided reinforcement ribs 15*x*, 15*y* running between the upper tightened portions 15*n*, 15*p* and the lower tightened portion 15*h*. These reinforcement ribs 15*x*, 15*y* can have opened leading ends as shown in FIG. 4, but preferably have closed leading end portions in a pipe-like configuration as shown in FIG. 14.

Figure 8:
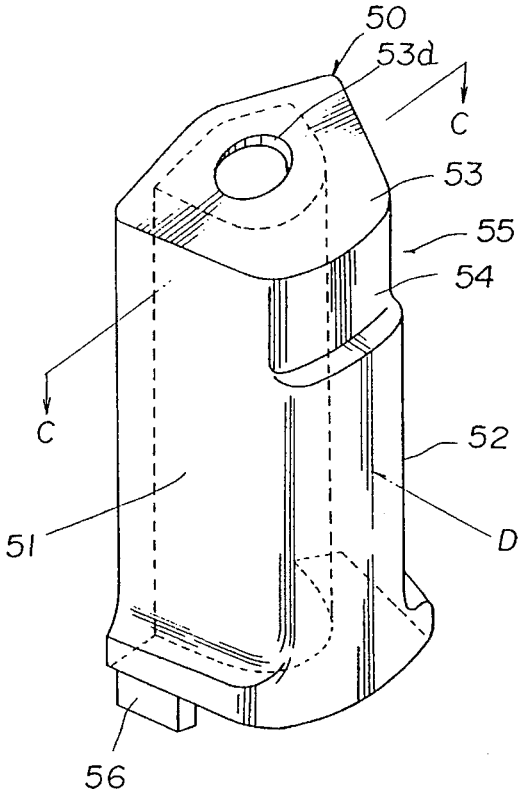
FIG. 8 is a perspective view showing a cover holding member.
Figure 10:
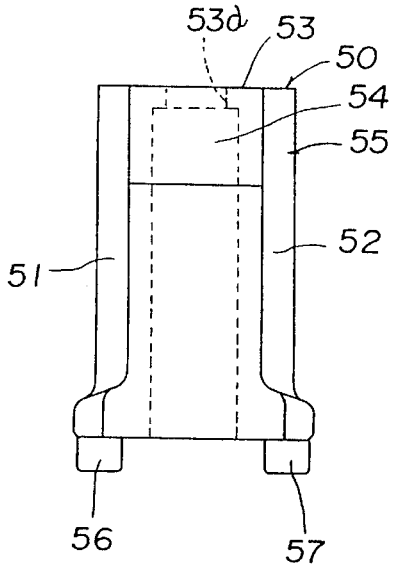
FIG. 10 is a view viewed along the arrow line D.
Figure 9:
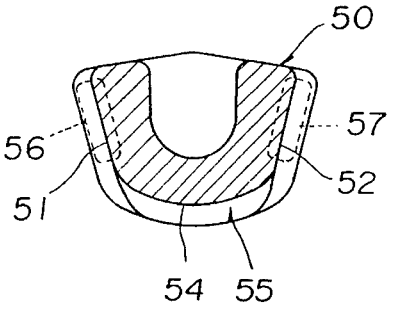
FIG. 9 is a sectional view taken along the C—C line in FIG. 8.

As shown in FIGS. 8 through 10, the cover holding member 50 is elongated and formed to have side surfaces 51, 52 which define the lower opening edges of the introducing openings 15*b*, 15*e* and is provided at its one end with a cover receiving portion 55 having a seat 53 onto which the inner surface of the lower tightened portion 15*h* of the wheel cover 15 sits and a curved engagement surface 54 with which the inner surface of the engaging piece 15*i* engages. At its lengthwise other end portion there is a pair of angular lugs 56, 57 adapted to fit into a pair of angular fitting openings 43 formed in the first side plate 1. A passing opening 53*a* through which the stay bolt 12 passes is formed in the seat 53, so that the cover holding member 50 can be fixedly secured to the first side plate 1 together with the cover 15 by tightening the nuts 17 threadably engaged with the projecting portions of the stay bolts 12 running along the insides of the side surfaces 51, 52 and projected from the passing opening 53*a* and the passing opening 15*g* of the tightened portion 15*h* respectively.

Figure 6:
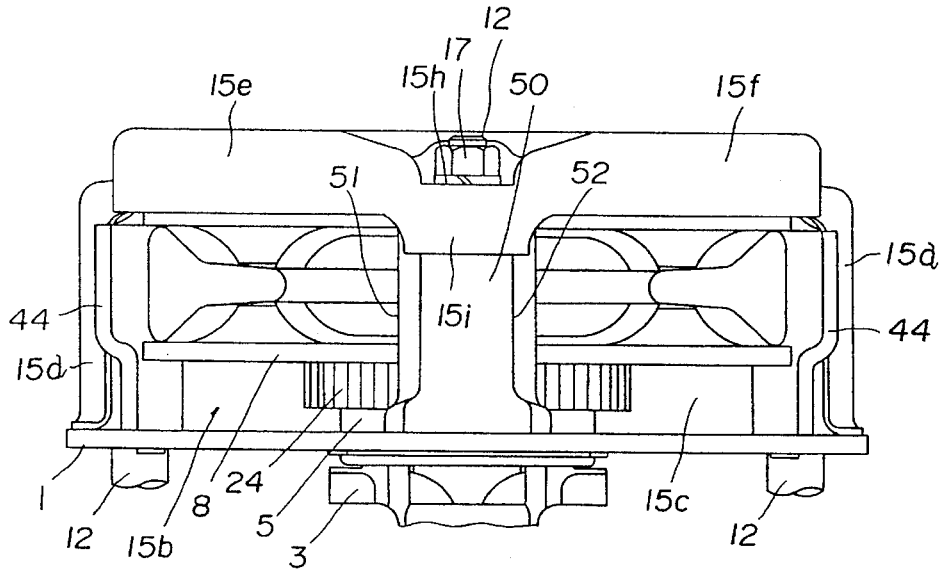
FIG. 6 is a bottom view showing the wheel cover portion.

Thus, the cover holding member 50 can be fixedly secured to the first side plate 1 together with the wheel cover 15 by tightening the nut 17 threadably engaged with the stay bolt 12 at the lower side portion of the wheel cover 15. The inner surface of the lower tightened portion 15*h* is seated at the seat 53 of the cover holding member 50 and the inner surface of the cover engaging piece 15*i* is engaged with the engagement surface of the cover receiving portion 55. Also by tightening the nuts 17 threadably engaged with the stay bolts 12, the upper side portion 15*d* of the wheel cover 15 can be fixedly secured to the first side plate 1 with the end faces of the cover side wall 15*a* being kept in contact with the first side plate 1. The hand chain guides 44, to be explained later, are interposed insides of the upper tightened portions 15*n*, 15*p* as shown in FIGS. 2 and 6, so that the end faces of the cover side wall 15*a* are pushed against the first side plate 1 and the hand chain guides 44, are fixedly secured between the inner surfaces of the upper tightened portions 15*n*, 15*p* and the first side plate 1.

Accordingly, the wheel cover 15 can be stably secured to the first side plate 1 by three stay bolts 12 as well as the introducing openings 15*b*, 15*c* whose lower opening edges are defined by the side surfaces 51, 52 of the cover holding member 50.

The cover holding member 50 is made separate from the wheel cover 15 and formed as shown in FIG. 8 with its side surfaces 51, 52 defining the lower opening edges of the introducing openings 15*b*, 15*c*. It is possible to obtain much greater strength in comparison with a conventional embodiment which has the introducing openings formed by the cover side walls.

Since the cover holding member 50 has sufficient strength as mentioned above, it is possible to space apart the positions of the lower opening edges from the introducing passages 60 of the hand chain 40 by narrowing a space between the side surfaces 51, 52 defining the lower opening edges, to decrease the chances of contact between the hand chain 40 and the side surfaces 51, 52 at the positions spaced apart from the introducing passages 60. This tends to decrease the generation of contact noises and improve the durability. Further, since the cover holding member 50 can be formed separately from the wheel cover 15 made of the steel plate, it can be made of a vibration proof material such as cast iron, aluminum, synthetic resin and iron. Therefore, greater silence can be attained by the manufacturing from those materials. Thereupon, even when the hand chain 40 is brought into contact therewith, it is possible to restrain the generation of peculiar noises and at the same time to accomplish a decrease of weight by using the light material such as aluminum.

In the above-mentioned embodiment, by disposing the short cover engaging piece 15*i* (FIG. 7) of arcuate cross section in the lower portion of the wheel cover 15 and making the engaging piece 15*i* engage with the engagement surface 54 (FIG. 8) of the cover receiving portion 55 of the cover holding member 50 the cover engaging member 15*i* can hold the cover receiving portion 55. Therefore, even when an impact is imposed on the wheel cover 15 from outside, it is possible to avoid or decrease any deformation of the wheel cover 15 due to the reinforcement attained by being held onto the cover receiving portion 55 and to stably fix the wheel cover 15 onto the first side plate 1 without any shifting of its position.

Further, in the above construction, by interposing a vibration absorbing material 58 (FIG. 1) such as a rubber packing between the seat 53 of the cover receiving portion 55 and the inner surface of the tightened portion 15*h* adapted to sit on the seat 53 it is possible to effectively prevent the undesirable noises from being generated by the resonance of the cover 15 to which vibrations are transmitted when the hand chain 40 is brought into contact with the cover holding member 50.

Since the configurations of the side portions 15*e*, 15*f* of the wheel cover 15 run along the outer periphery of the hand wheel 8, the lower tightened portion 15*h* is protruded radially downward and outwardly relative to these side portions 15*e*. It is thus possible to decrease the chances of contact of the hand chain 40 with the opening edges of the introducing openings 15*b*, 15*c* formed in the side portions 15*e*, 15*f* so to decrease the generation of undesirable noises even when the hand chain 40 is operated at a slant and toward the axial direction of the hand wheel 8.

Next, the hand chain guide 44 will be explained.

Figure 3:
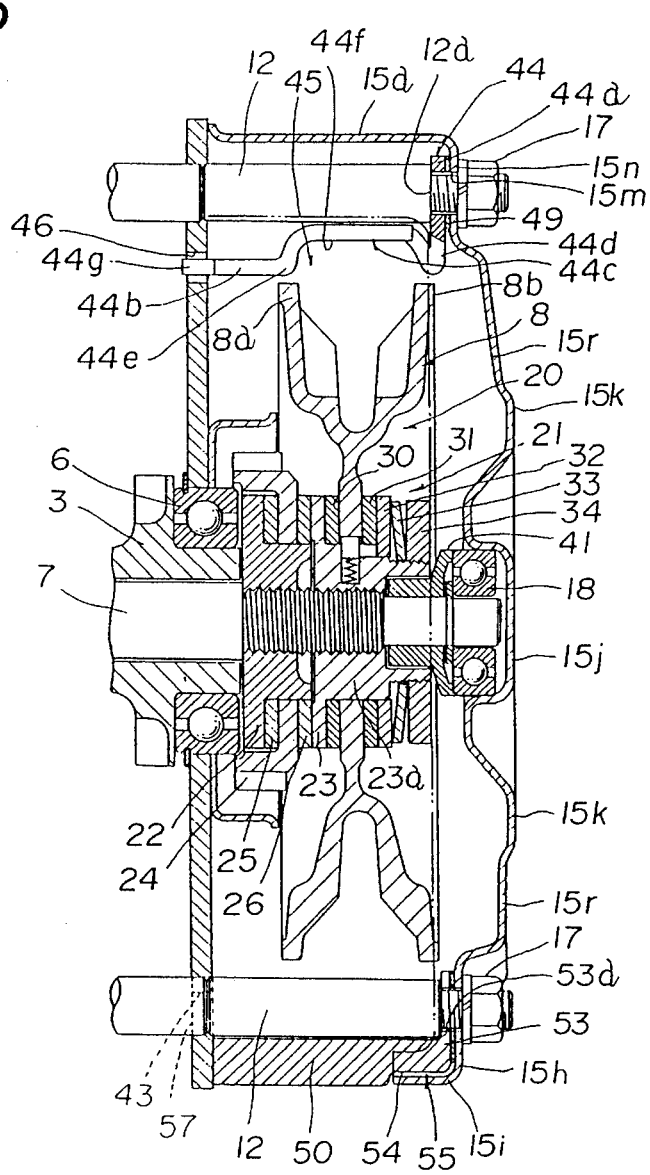
FIG. 3 is a sectional view taken along the A—A line in FIG. 2.
Figure 11:
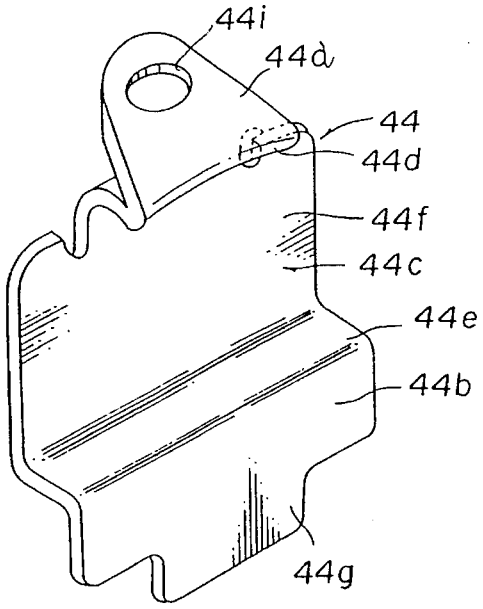
FIG. 11 is a perspective view showing a hand chain guide.

As shown in FIGS. 2, and 3 FIG. 6, and particularly FIG. 11, the hand chain guide 44 comprises an attachment portion 44*a* having a bolt passing opening 44*i* and interposed between the tightened portion 15*n*, 15*p* of the wheel cover 15 and the stay bolt 12, a held portion 44*b* adapted to be engaged and held by the side plate 1 and a guide portion 44*c* formed between the attachment portion 44*a* and the held portion 44*b* and facing the hand wheel 8 to guide the hand chain 40 looped around the hand wheel 8. The hand chain is provided separately from the wheel cover guides 44 are fixedly secured between the side plate 1 and the tightened portions 15*n*, 15*p* of the wheel cover 15 by tightening the nuts 17 relative to the stay bolts 12.

Figure 12:
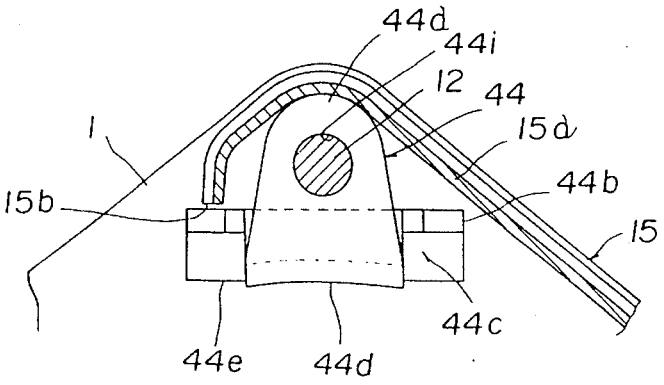
FIG. 12 is a plan view showing the hand chain guide.

In detail, the hand chain guide 44 is generally formed of a thick steel plate. As shown in FIGS. 11 and 12, an outer surface of the attachment portion of 44*a* is so formed as to coincide with the inner surface of the cover side wall 15*a* at the tightened portion 15*n*, 15*p* of the wheel cover 15. When the attachment portion 44*a* is interposed between the tightened portions 15*n*, 15*p* and a stepped portion 12*a* of the stay bolt 12, the outer surface of the attachment portion 44*a* is brought into contact with the inner surface of the cover side wall 15*a* as shown in FIG. 12 or comes so near as to contact therewith. The guide portion 44*c* comprises protruding portions 44*d*, 44*e* swelled out toward wheel flanges 8*a*, 8*b* of the hand wheel 8 to oppose respectively a concaved portion 44*f*. As shown in FIG. 3, the protruding portions 44*d*, 44*e* are opposed to the wheel flanges 8*a*, 8*b* and define a smaller gap than a width of the hand chain 40 to define a guide passage 45 for the hand chain 40 together with the concaved portion 44*f* between the the wheel flanges 8*a*, 8*b*.

Further, the held portion 44*b* is joined to the protruded portion 44*e* while being provided at its end face with a lug 44*g* protruded toward the side plate 1. A fitting hole 46 for receiving the lug 44*g* is formed in the side plate 1 as shown in FIG. 3. The lug 44*g* can be fitted into the fitting hole 46 to hold the held portion 44*b* by engagement with the side plate 1.

Incidentally, it is preferable to keep the outer surface of the concaved portion 44*f* of the guide portion 44*c* in contact with the stay bolt 12, but a small gap may be provided therebetween. Further, the end face of the held portion 44*b* is preferably brought into pressed contact with the side plate 1 by tightening the nuts 17 relative to the stay bolt 12, but a small gap may exist in therebetween the case of engaging and holding by the lug 44*g*.

As mentioned above, since the-hand chain guides 44 are fixedly secured at the tightened portions 15*n*, 15*p* together with the cover holding member 50 by tightening the nuts 17 relative to the stay bolts 12, the hand chain 40 can be guided suitably by these hand chain guides 44 allowing the hand chain 40 to be smoothly operated. Further, since each hand chain guide 44 is interposed between the inner surface of the tightened portion 15*n*, 15*p* and the stepped portion 12*a* of the stay bolt 12 so that its outer surface is brought into contact with the cover side wall 15*a* at the tightened portions 15*n*, 15*p* or comes near thereto as well as the held portion 44*b* is engaged and held by the side plate 1, a box-like section can be defined between the cover side wall 15*a* and the side plate 1 to strongly reinforce the wheel cover 15. Therefore, even when an impact is imposed thereto from outside, it can be received by the stay bolt 12 which have good rigidity through the attachment portion 44*a* to effectively restrain any deformation of the wheel cover 15.

Because the attachment portions 44*a* are interposed between the tightened portions 15*n*, 15*p* and the stepped portions 12*a* of the stay bolts 12 and the lug 44 is merely fitted into the fitting hole 46 of the side plate 1 and held by the engagement therebetween, it is possible to attain the above-mentioned sufficient reinforcement and to simplify the mounting. Further, since the hand chain guides 44 are provided separately from the wheel cover 15, it is possible to simplify the manufacture of the wheel cover 15. Since the hand chain guide 44 is a small component part, its manufacturing accuracy can be improved. Furthermore, since the attachment portions 44*a* are interposed and fixed between the tightened portions 15*n*, 15*p* and the stepped portions 12*a* of the stay bolts 12, the assembling accuracy can be improved and shifts of their positions can be avoided.

Further, by forming the hand chain guide 44 from a vibration resistant material such as cast iron, aluminum or synthetic resin it is possible to effectively restrain the generation of undesirable noises even when the hand chain 40 is brought into contact therewith.

Figure 13:
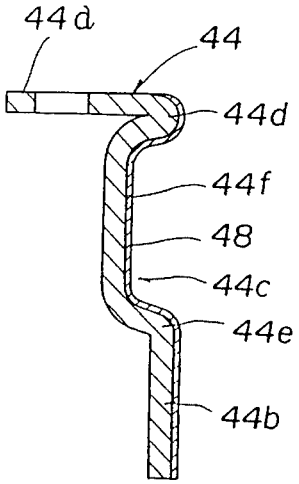
FIG. 13 is a sectional view showing another embodiment of a hand chain guide.

As shown in FIG. 13, by coating the whole surface of the hand chain guide 44 or at least the surface thereof facing the hand wheel 8 with the synthetic resin or a like it is possible to form a vibration proof layer 48 to effectively restrain the generation of undesirable noises caused by contact with the hand chain guide 44.

Further, as shown in FIG. 3, by interposing a vibration absorbing material 49 such as the rubber packing between the attachment portion 44*a* and the tightened portion 15*n*, 15*p* it is possible to prevent undesirable noises from being generated by the resonance of the wheel cover 15 even when the hand chain 40 is brought into contact with the hand chain guide 44.

The hand chain guide 44 can be readily mounted by interposing the attachment portion 44*a* between the tightened portion 15*n*, 15*p* and the stay bolt 12 and fitting the lug 44*g* of the held portion 44*b* into the fitting hole 46 of the side plate 1. Its mountability can be further improved by fixing the attachment portion 44*a* to the tightened portion 15*n*, 15*p* for example by means of a spot welding.

Incidentally, in the above-mentioned embodiment, though the overload prevention mechanism 21 is assembled in the manual actuating mechanism 20, this overload prevention mechanism 21 is not always needed and also the reduction gear mechanism 11 may be omitted.

Further, though the driving shaft 7 is supported at its axial opposite end portions by the radial bearings 18, 19 provided in the wheel cover 15 and the gear cover 16, it may be supported by the load sheave 3 or supported at its axial one end portion by one of the wheel cover 15 and the gear cover 16 and at its intermediate shaft portion by the load sheave 3.

This invention has been described in detail with particular reference to preferred embodiments thereof, but it will be understood that variations and modifications can be effected within the spirit and scope of the invention.

What is claimed is:

1. A manual chain block comprising:

a pair of side plates;

a load sheave rotatably supported between said side plates and around which a load chain is looped, an actuating mechanism disposed outside one of said side plates, having a hand chain looped around a hand wheel for actuating said load sheave;

a wheel cover for covering said actuating mechanism, said wheel cover having introducing openings for said hand chain to pass through and a cover holding member for holding said wheel cover to one of said side plates, said cover holding member being provided separately from said wheel cover and located between said introducing openings, said cover holding member having (i) side surfaces defining lower edges of said introducing openings, said side surfaces being located relative to each other such that said lower edges are spaced apart from a usual movement pathway of said hand chain, and (ii) a cover receiving portion for receiving said wheel cover, such that said cover holding member is tightened with said wheel cover to said side plate by a stay bolt.

2. A manual chain block as set forth in claim 1, wherein said cover holding member is formed from a vibration resistant material.

3. A manual chain block as set forth in claim 1, wherein said wheel cover includes a short cover engaging piece having an arcuate cross-section disposed between the lower edges of said introducing openings and said cover receiving portion of said cover holding member has an engaging surface engageable with an inner surface of said cover engaging piece.

4. A manual chain block as set forth in claim 1, wherein said cover receiving portion has a seat onto which the inner surface of said wheel cover sits, and a vibration absorbing material is interposed between the seat and the inner surface of said wheel cover.

5. A manual chain block as set forth in claim 1, wherein said wheel cover is located radially outside an outer peripheral portion of said hand wheel and comprises (i) an upper side portion having cover side walls curving around into left and right sides, (ii) said left and right side portions having said introducing openings for the hand chain and extending along an outer peripheral portion of said hand wheel; and (iii) a lower tightening portion connected to the lower portions of said left and right side portions, said lower tightening portion protruding radially outward relative to the outer peripheral portion of said hand wheel and resting on said cover holding member to be tightened together with said cover holding member by the stay bolt.

6. A manual chain block as set forth in claim 1, including at least one hand chain guide comprising (i) an attachment portion interposed between a tightening portion of said wheel cover by a stay bolt; (ii) a held portion held by said side plate, and (iii) a guide portion extending between said attachment portion and said held portion and facing said hand wheel so as to guide said hand chain looped around said hand wheel, said hand chain guides being secured between said side plate and the tightening portions of said wheel cover by tightening the stay bolts.

7. A manual chain block as set forth in claim 6, wherein the attachment portion of said hand chain guide has an outer surface which coincides with the inner surface of said cover side wall of the tightening portion of the wheel cover.

8. A manual chain block as set forth in claim 6, wherein the guide portion of said hand chain guide has protruding portions extending toward wheel flanges of said hand wheel opposite to each other such that the protruding portions and the wheel flanges confront each other with a clearance smaller than a width of the hand chain to define a guide passage for the hand chain.

9. A manual chain block as set forth in claim 6, wherein said hand chain guide is formed from a vibration resistant material.

10. A manual chain block as set forth in claim 6, wherein a vibration resistant layer is formed on the surface of the guide portion of said hand chain guide which faces toward said hand wheel.

11. A manual chain block as set forth in claim 6, wherein a vibration absorbing material is interposed between the attachment portion of said hand chain guide and the tightening portion of said wheel cover.

12. A manual chain block as set forth in claim 6, wherein the attachment portion of said hand chain guide is fixed to the tightening portion of said wheel cover.

13. A manual chain block as set forth in claim 6, wherein the held portion of said hand chain guide is provided with a lug protruded from its end portion, and said side plate is provided with a fitting hole for receiving said lug.

* * * * *